US009866984B2

(12) United States Patent
Kim et al.

(10) Patent No.: US 9,866,984 B2
(45) Date of Patent: Jan. 9, 2018

(54) METHOD FOR GENERATING SURROUND CHANNEL AUDIO

(71) Applicant: GWANGJU INSTITUTE OF SCIENCE AND TECHNOLOGY, Gwangju (KR)

(72) Inventors: Hong Kook Kim, Gwangju (KR); Su Yeon Park, Gwangju (KR); Chan Jun Chun, Gwangju (KR)

(73) Assignee: GWANGJU INSTITUTE OF SCIENCE AND TECHNOLOGY, Gwangju (KR)

( * ) Notice: Subject to any disclaimer, the term of this patent is extended or adjusted under 35 U.S.C. 154(b) by 0 days.

(21) Appl. No.: 15/355,053

(22) Filed: Nov. 18, 2016

(65) Prior Publication Data

US 2017/0171683 A1 Jun. 15, 2017

(30) Foreign Application Priority Data

Dec. 14, 2015 (KR) ..... 10-2015-0178464

(51) Int. Cl.
*H04R 5/00* (2006.01)
*H04S 5/00* (2006.01)
(Continued)

(52) U.S. Cl.
CPC ..... *H04S 5/005* (2013.01); *G10L 19/008* (2013.01); *G10L 19/0212* (2013.01); *G10L 19/16* (2013.01); *G10L 25/30* (2013.01)

(58) Field of Classification Search
CPC ..... H04S 5/00; H04S 5/005; G10L 19/0212; G10L 19/16
(Continued)

(56) References Cited

U.S. PATENT DOCUMENTS 8,054,980 B2 * 11/2011 Wu ..... H04S 5/005 381/1
2005/0169482 A1 * 8/2005 Reams ..... H04S 3/00 381/17
(Continued)

OTHER PUBLICATIONS

[Supportive Materials for Exception to Loss of Novelty] Su Yeon Park et al., "Generation of Surround Channel Audio Using Deep Neural Networks for Multi-Channel Audio Services", the Convergent Research Society Among Humanities, Sociology, Science, and Technology, 2015, 6 pages.

*Primary Examiner* — Disler Paul
(74) *Attorney, Agent, or Firm* — Hauptman Ham, LLP

(57) ABSTRACT

A method includes extracting a difference value through extraction of features of a front audio channel signal and a surround channel of multichannel sound content by setting the front audio channel signal and the surround channel as input and output channel signals, respectively, training a deep neural network (DNN) model by setting the input channel signal and the difference value as an input and an output of the DNN model, respectively, normalizing a frequency-domain signal of the input channel signal by converting the input channel signal into the frequency-domain signal, and extracting estimated difference values by decoding the normalized frequency-domain signal through the DNN model, deriving an estimated spectral amplitude of the surround channel based on the front audio channel signal and the difference value, and deriving an audio signal of a final surround channel by converting the estimated spectral amplitude of the surround channel into the time domain.

8 Claims, 4 Drawing Sheets

(51) Int. Cl.

| | |
|---|---|
| ***G10L 19/02*** | (2013.01) |
| ***G10L 19/16*** | (2013.01) |
| ***G10L 19/008*** | (2013.01) |
| *G10L 25/30* | (2013.01) |

(58) Field of Classification Search
USPC ..... 381/1, 17–18
See application file for complete search history.

(56) References Cited

U.S. PATENT DOCUMENTS

| | | | | |
|---|---|---|---|---|
| 2009/0238370 | A1* | 9/2009 | Rumsey | H04R 29/00 381/58 |
| 2009/0313029 | A1* | 12/2009 | Luo | G10L 19/008 704/500 |
| 2016/0092766 | A1* | 3/2016 | Sainath | G10L 25/30 706/20 |

* cited by examiner

METHOD FOR GENERATING SURROUND CHANNEL AUDIO

CROSS REFERENCE TO RELATED APPLICATION

This application claims the benefit of Korean Patent Application No. 10-2015-0178464, filed on Dec. 14, 2015, entitled "METHOD FOR GENERATING SURROUND CHANNEL AUDIO", which is hereby incorporated by reference in its entirety into this application.

BACKGROUND

1. Technical Field

The present invention relates to a method of generating surround channel audio, and more particularly, to a method of generating surround channel audio for conversion into lively multichannel audio content by generating a surround channel corresponding to an input stereo channel using a trained DNN-based surround channel model.

2. Description of the Related Art

With increasing number of people who want to enjoy movies or the like in a state of higher-quality video and audio, importance of more dynamic and realistic sounds increases. Thus, people, who spare no expense in purchasing multichannel speakers or the like for projectors or large-size displays, increase, and techniques of improving immersiveness of users in the fields of communications, broadcasting and household appliances are proposed.

A multichannel audio system generally includes a front audio channel and a rear surround channel, and thus can reproduce better realism than a stereo audio system. However, since most audio content actually includes only a front audio channel, it is difficult to obtain realism due to a surround channel, when audio content is stereo audio content even though a multichannel audio system is established.

Generally, the term "surround" means to enclose surroundings and surround sound technology is sound technology developed after emergence of stereo technology expressing left and right sounds. For example, although left and right sounds need to be different since humans use both their ears, since a typical mono sound outputs only one sound, the stereo technology has been developed to supplement such a mono sound. However, although a sound from a short distance is different in feeling from a sound from a long distance, since the stereo technology cannot properly express such a feeling, surround sound technology has been developed to more realistically express surrounding sounds by supplementing stereo technology.

To realize such a surround sound, there has been proposed a method of generating a surround channel by separating a front sound recorded in stereo into multiple channels, followed by performing post-treatment such as panning and reverberation treatment for the front sound. However, since a nonlinear relationship between a front sound of actual multichannel content and a generated rear sound is not taken into account in this method, there is a problem of deterioration of realism and immersiveness in providing multichannel content.

BRIEF SUMMARY

The present invention has been conceived to solve the problems as set forth above and it is an aspect of the present invention to provide more realistic multichannel sound by taking into account a nonlinear relationship between a front channel and a surround channel of actual multichannel audio content.

In accordance with one aspect of the present invention, a method of generating surround channel audio includes: extracting a difference value through extraction of features of a front audio channel signal and a surround channel of multichannel sound content by setting the front audio channel signal and the surround channel as input and output channel signals, respectively; training a deep neural network (DNN) model by setting the input channel signal and the difference value as an input and an output of the DNN model, respectively; normalizing a frequency-domain signal of the input channel signal by converting the input channel signal into the frequency-domain signal, and extracting estimated difference values by decoding the normalized frequency-domain signal through the DNN model; deriving an estimated spectral amplitude of the surround channel based on the front audio channel signal and the difference value; and deriving an audio signal of a final surround channel by converting the estimated spectral amplitude of the surround channel into a time domain.

In extracting a difference value through extraction of features of each of a front audio channel signal and a surround channel of multichannel sound content by setting the front audio channel signal and the surround channel as input and output channel signals, respectively, the front audio channel signal and a rear audio channel signal are converted into spectral amplitudes of the respective signals by performing short-time Fourier transform (STFT) thereof, followed by extracting the features of the respective signals.

The method may further include normalizing the difference value and the spectral amplitude of the front audio channel signal to a value of 0 to 1, the difference value being a feature value derived through the spectral amplitudes of the front audio channel signal and the rear audio channel signal.

According to the present invention, a rear audio channel generated through modeling and learning of stereo channel audio content satisfies high correlation and nonlinear relationship with a front audio channel, whereby more lively and realistic audio content can be produced.

BRIEF DESCRIPTION OF THE DRAWINGS

The above and other aspects, features, and advantages of the present invention will become apparent from the detailed description of the following embodiments in conjunction with the accompanying drawings.

DETAILED DESCRIPTION

Hereinafter, embodiments of the present invention will be described in detail with reference to the accompanying drawings. However, it should be understood that the present invention is not limited to the following embodiments. Descriptions of details of functionalities or configurations known in the art may be omitted for clarity.

It is one aspect of the present invention to provide a more realistic multichannel sound by taking into account a nonlinear relationship between a front channel of actual multichannel content and a surround channel. According to one embodiment of the present invention, a method of generating surround channel audio may include training a surround channel model and generating a surround channel.

As for overall flow of the method of generating surround channel audio according to the embodiment, the method may include: extracting a difference value through extraction of features of a front audio channel signal and a surround channel of multichannel sound content by setting the front audio channel signal and the surround channel as input and output channel signals, respectively; training a deep neural network (DNN) model by setting the input channel signal and the difference value as an input and an output of the DNN model, respectively; normalizing a frequency-domain signal of the input channel signal by converting the input channel signal into the frequency-domain signal, and extracting estimated difference values by decoding the normalized frequency-domain signal through the DNN model; deriving an estimated spectral amplitude of the surround channel based on the front audio channel signal and the difference value; and deriving an audio signal of a final surround channel by converting the estimated spectral amplitude of the surround channel into a time domain. Each operation will be described in more detail with reference to FIGS. 1 to 4.

Figure 1:
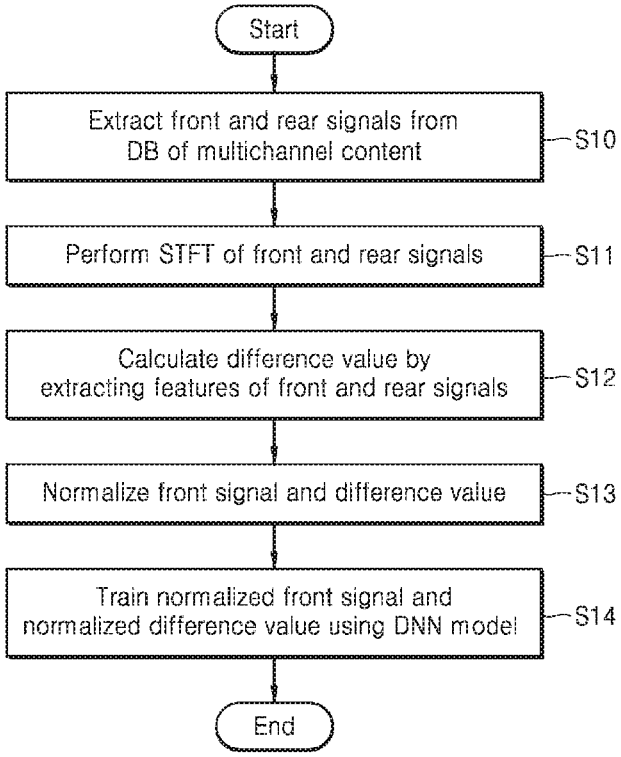
FIG. 1 is a flowchart of operation of training in a method of generating surround channel audio according to one embodiment of the present invention.
Figure 2:
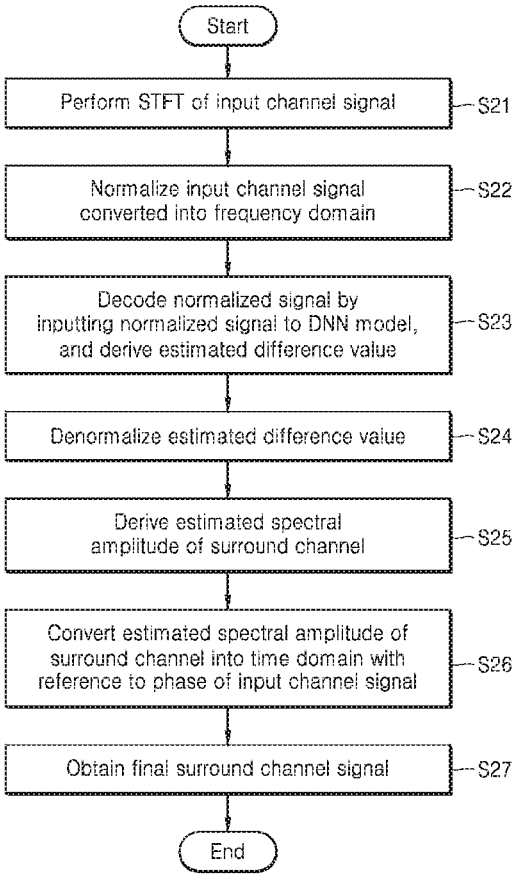
FIG. 2 is a flowchart of operation of generating a surround channel in the method of generating surround channel audio according to the embodiment of the present invention.

FIG. 1 is a flowchart of operation of DNN training in the method of generating surround channel audio according to one embodiment of the present invention and FIG. 2 is a flowchart of operation of generating a surround channel in the method of generating surround channel audio according to the embodiment of the present invention.

Referring to FIG. 1, first, in order to train a surround channel model, front and rear signals from DB of the multichannel content may be extracted (S10). According to the embodiment, a front channel corresponding to an input audio channel and a rear channel corresponding to an output audio channel are defined using an orchestra sound source, which has a length of about 1 hour and 10 minutes and is recorded according to the 5.1 channel standard, as the multichannel content. For example, the input audio channel may be a left channel of a stereo signal, and the output audio channel may be a left channel of the rear signal.

Hereinafter, the front signal may be understood as a signal coming out of a front channel of the multichannel audio content and the rear signal may be understood as signals coming out of a rear channel (surround channel) of the multichannel audio content. In addition, the rear channel may be understood as a surround channel.

Next, the front and rear signals into spectral amplitude signals in a frequency domain may be changed by performing short-time Fourier transformation (STFT) of the front and rear signals (S11). Next, a difference value between the spectral amplitude signals of the front and rear signals may be calculated by extracting features thereof (S12). The difference value indicates a difference in spectral amplitude between the front and surround channels and is represented by Equation 1.

$$|S_D(k)| = |S_R(k)| - \epsilon |S_F(k)| \quad \text{[Equation 1]}$$

wherein $|S_F(k)|$ represents the front signal, $|S_R(k)|$ represents the rear signal, and $|S_D(k)|$ represents the difference value.

$|S_D(k)|$, which is the difference value, is represented by a difference between the spectral amplitude of the front signal ($|S_F(k)|$) and the spectral amplitude of the rear signal ($|S_R(k)|$) to limit the range of a spectral amplitude of the surround channel generated from the DNN model. That is, $|S_D(k)|$ may be obtained by subtracting a certain proportion of the spectral amplitude of the front signal ($|S_F(k)|$) from the spectral amplitude of the rear signal ($|S_R(k)|$). $\epsilon$ representing the certain proportion has a value of 0 to 1, preferably 0.5.

Next, the front signal and the difference value are normalized (S13) to adjust sizes of the spectral amplitudes thereof to 0 to 1. Next, the front signal and the difference value, which are normalized, may be trained using the DNN model (S14). Here, the normalized front signal may be set as an input of the DNN model, and the normalized difference value may be set as an output of the DNN model.

According to the embodiment, particularly, in operation of training for generating the surround channel, a deep neural network (DNN) is applied. The DNN is a branch of machine learning and refers to machine learning attempting high-level abstraction through combination of several nonlinear conversion techniques. In addition, the DNN can be generally described as a branch of machine learning for teaching a human way of thinking to a computer.

The DNN is an artificial neural network including a plurality of hidden layers between an input layer and an output layer, and can model complicated nonlinear relationships. According to the embodiment, the method of generating a surround channel may perform DNN modeling through RBM-based pre-training and DBN-based fine-tuning.

FIG. 2 is a flowchart of operation of generating a surround channel in the method of generating surround channel audio according to the embodiment.

Referring to FIG. 2, in operation of generating the surround channel, STFT of a stereo channel signal, which is the input channel signal, is performed first (S21). Here, it is assumed that the stereo channel signal is a signal having 5.1 channels or more and includes a left channel and a right channel.

Next, a channel signal converted into a frequency domain by STFT may be normalized (S22). Through operation S22, the channel signal may be converted into spectral amplitude information having a value of 0 to 1.

Next, a difference value between the input channel signal and the surround channel signal may be derived as an output value by decoding the normalized channel signal by inputting the normalized channel signal into the input of the DNN model (S23). The difference value derived in operation S23 is a difference value estimated through the DNN model.

The process of training the DNN model by extracting the features of the front channel signal and the surround channel has been previously performed in operation of training of FIG. 1. Therefore, in the DNN model, trained difference values for a plurality of front signals may be present, and a process of finding difference values for the stereo signal, frame by frame, when the stereo signal is given as an input signal to the DNN model may be included.

Next, the difference value may be denormalized (S24), and an estimated spectral amplitude of the surround channel may be derived based on the denormalized difference value and a spectral amplitude signal of the input channel signal (S25).

Next, inverse STFT of the estimated spectral amplitude of the surround channel may be performed with reference to a phase of the input channel signal (S26). As described above, when inverse STFT is performed, the estimated spectral amplitude may be converted back into a time domain to generate a final surround channel signal (S27).

Figure 3:
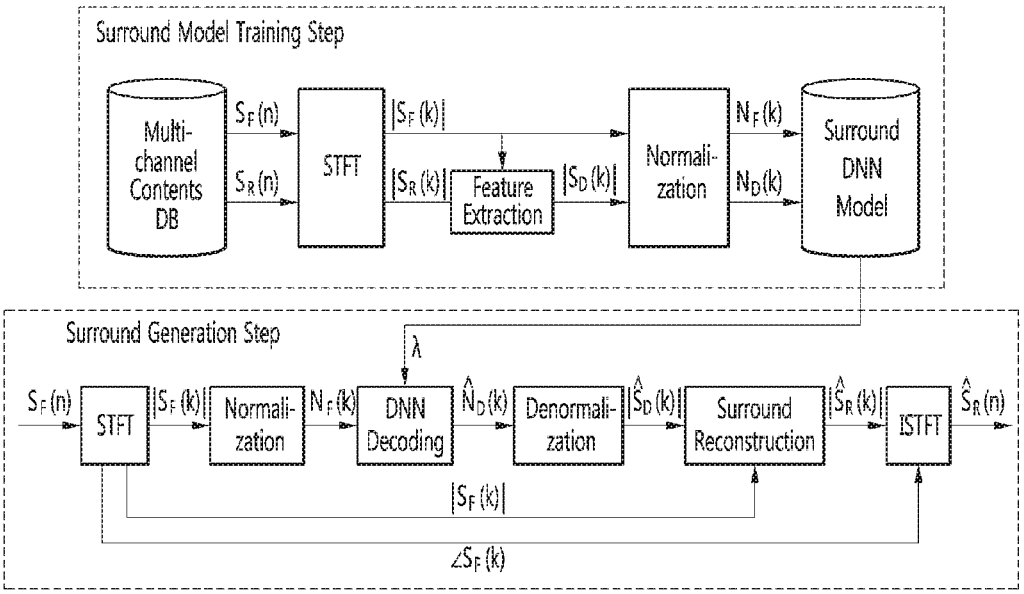
FIG. 3 is a diagram showing specific signal flow in operations of training and channel generation in order to generate a surround channel audio.

FIG. 3 is a diagram showing details of signal flow in operations of training and channel generation in order to generate surround channel audio.

Referring to FIG. 3, in operation of surround model training, the front channel signal $S_F(n)$ and the rear channel signal $S_R(n)$ are extracted from the multichannel content DB recorded in advance, and converted into $|S_F(k)|$ and $|S_R(k)|$, which are the spectral amplitude signals corresponding to a frequency domain, by performing STFT of the front channel signal $S_F(n)$ and the rear channel signal $S_R(n)$, respectively.

The features of the front channel signal and the rear channel signal, which are converted into the spectral amplitude signals, are extracted, thereby deriving $|S_D(k)|$ which is the difference value therebetween. The spectral amplitude signal $|S_F(k)|$ and the difference value $|S_D(k)|$ are input as the input and output values into the DNN model, respectively, thereby training the DNN model to store a parameter including correlations between a plurality of inputs and outputs.

When the operation of training as set forth above is completed, a plurality of trained layers, which form a network, are present in the DNN model, and the rear channel signal for the same kind of sound source as the sound source trained in the DNN model may be generated. If the rear channel signal for a different kind of sound source is to be generated, the process of training the DNN model needs to be performed again with respect to the corresponding DB.

Details of signal flow in the operation of generating the surround channel are as follows. To form an additional audio channel, the front signal of the multichannel signal is taken as the input channel signal $S_F(n)$, and STFT of the input channel signal $S_F(n)$ is performed. When STFT is performed, the input channel signal $S_F(n)$ is converted into the spectral amplitude signal $|S_F(k)|$, and the spectral amplitude signal $|S_F(k)|$ is normalized to be spectral amplitude information $N_F(k)$ having a value of 0 to 1.

Operation of DNN decoding is performed using the spectral amplitude information $N_F(k)$ as an input and using $\lambda$, which is DNN model information of the trained surround channel using $|S_D(k)|$ corresponding to the difference value obtained by feature extraction, thereby obtaining $\hat{N}_D(k)$, which is the normalized difference value corresponding to $N_F(k)$. The normalized difference value $\hat{N}_D(k)$ is converted into $|\hat{S}_D(k)|$, which is the estimated spectral amplitude of the difference value, through denormalization of $\hat{N}_D(k)$, and $|\hat{S}_R(k)|$, which is the estimated spectral amplitude of the surround channel, may be derived with reference to $|\hat{S}_D(k)|$ and $|S_F(k)|$, which is the spectral amplitude of the input stereo channel.

In the process of forming the surround channel, $|\hat{S}_R(k)|$ may be derived by Equation 2.

$$|\hat{S}_R(k)| = \epsilon|S_F(k)| + |\hat{S}_D(k)| \quad \text{[Equation 2]}$$

wherein $|S_F(k)|$ is the spectral amplitude of the front signal, $|\hat{S}_R(k)|$ is the estimated spectral amplitude of the rear signal, and $|\hat{S}_D(k)|$ is the estimated spectral amplitude of the difference value.

As in the operation of training, in order to limit the range of the spectral amplitude of the surround channel generated from the DNN model, the estimated spectral amplitude of the rear signal may be represented by the sum of the spectral amplitude of the front signal and the estimated spectral amplitude of the difference value. $\epsilon$ serves to adjust the degree of limiting the spectral amplitude of the front signal, and may have a value of 0 to 1. Preferably, $\epsilon$ has a value of 0.5, whereby the surround channel audio may be represented by the sum of ½ of the spectral amplitude of the front signal and the estimated spectral amplitude of the difference value.

Inverse STFT is performed on $|\hat{S}_R(k)|$ obtained as set forth above, whereby the final surround channel audio signal appearing in the time domain may be obtained from the estimated spectral amplitude of the rear signal.

Figure 4:
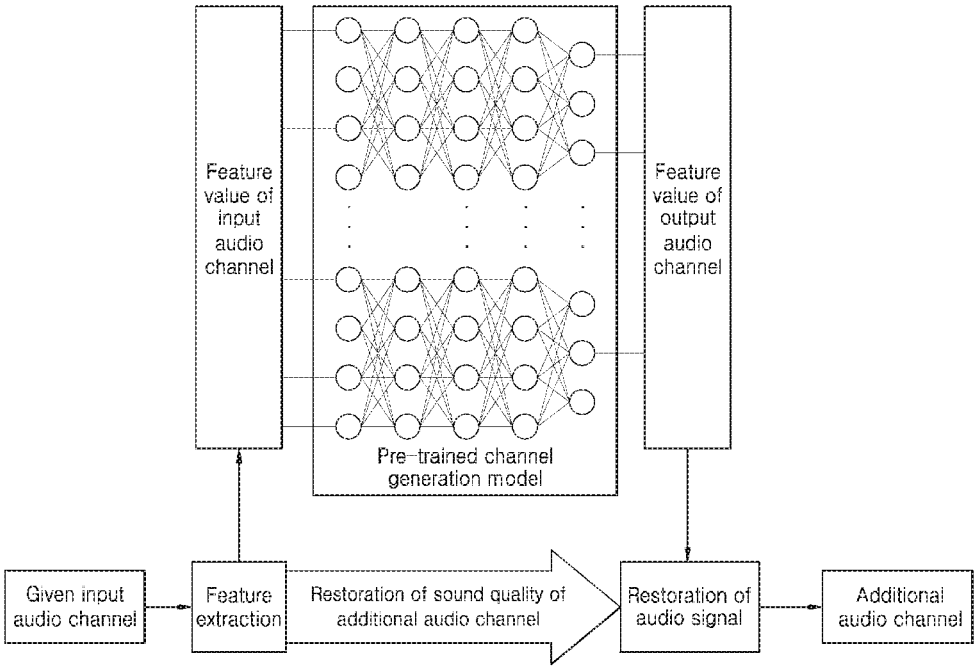
FIG. 4 is a diagram showing overall flow of the method of generating surround channel audio according to the embodiment of the present invention.

FIG. 4 is a diagram showing overall flow of the method of generating surround channel audio according to the embodiment of the present invention.

Referring to FIG. 4, in the method according to the embodiment, a feature value of the input audio channel and a feature value of the output audio channel are extracted from a sound source DB, followed by training the DNN model using the feature values. That is, the DNN model is a pre-trained channel generating model to generate surround channel audio for the input audio channel that is subsequently input.

Modeling techniques include a Gaussian mixture model (GMM), a hidden Markov model (HMM), and a deep neural network (DNN). In the techniques as set forth above, since the HMM considers a problem of energy mismatch between adjacent audio frames, the HMM exhibits better performance than the GMM.

However, since the DNN applied to the method according to the embodiment of the invention is subjected to pre-training based on RBM and fine-tuning based on DBN and minimum mean squared error (MMSE), the DNN can exhibit better performance than the HMM in terms of sound quality improvement.

After completion of training of the DNN model, the features for the input audio channel are extracted in order to generate the surround channel audio and a parameter required for generation of the additional audio channel refers to the features with reference to information of the pre-trained DNN model. An audio signal, in which a nonlinear relationship with the initially given input audio channel is taken into account, is restored through these processes, and the additional audio channel is finally generated, thereby generating the surround channel audio.

In order to evaluate the method of generating a surround channel according to the present invention, the method was compared with Dolby Pro Logic and decorrelation-based upmixing, which are existing methods and were used as comparative examples. For comparison, log-spectral distortion (LSD) between a surround channel audio signal of actual multichannel audio content and a generated surround channel audio signal was used as an objective measure. Three orchestra sound sources having a length of 10 minutes and recorded according to the 5.1 channel standard were used as audio content for performance evaluation, the sound source used in the process of DNN training of the method according to the present invention was not used in the process of generating the surround channel.

Table 1 shows LSD measurement results for left and right channels according to the methods of generating a surround channel. In Table 1, in the DNN-based method according to the embodiment of the invention, both the left and right channels exhibited lower LSD than the existing methods. This means that the method according to the embodiment of the present invention generated a surround channel more similar to the surround channel of the multichannel audio content than the existing methods of generating a surround channel.

TABLE 1

| | Orchestra 1 | | Orchestra 2 | | Orchestra 3 | | Orchestra 4 | |
|---|---|---|---|---|---|---|---|---|
| | L | R | L | R | L | R | L | R |
| Dolby Pro Logic | 2.305 | 2.478 | 2.754 | 2.783 | 2.637 | 2.657 | 2.565 | 2.640 |
| Decorrelation | 2.496 | 2.638 | 2.739 | 2.804 | 2.725 | 2.791 | 2.653 | 2.744 |
| DNN | 2.222 | 2.327 | 2.662 | 2.644 | 2.564 | 2.554 | 2.483 | 2.508 |

As shown in the results set forth above, the method according to the embodiment of the present invention modeled the stereo channel audio content in the manner as described above and allowed the rear audio channel generated through training to have high correlation with the front audio channel, thereby producing more lively and realistic audio content.

Although the present invention has been described with reference to some embodiments in conjunction with the accompanying drawings, it should be understood that the foregoing embodiments are provided for illustration only and are not to be construed in any way as limiting the present invention, and that various modifications, changes, alterations, and equivalent embodiments can be made by those skilled in the art without departing from the spirit and scope of the invention. For example, each of features in the embodiments can be modified. In addition, differences related to modifications, changes and alterations will be construed as being included within the scope of the present invention, as defined by the accompanying claims and equivalents thereof.

What is claimed is:

1. A method of generating surround channel audio in a front channel only stereo audio system from a surround channel audio signal comprising a front audio channel signal and a surround channel signal, comprising:

transforming the front audio channel signal and the surround channel signal into frequency-domain signals;

extracting a difference value of the transformed front audio channel signal and the transformed surround channel signal;

training a deep neural network (DNN) model using the difference value and the transformed front audio signal to obtain a DNN parameter;

normalizing the transformed front audio channel signal;

calculating an estimated difference value of the front audio channel signal and the surround channel signal from the normalized transformed front audio channel signal and the DNN parameter;

deriving an estimated transformed surround channel signal based on the front audio channel signal and the estimated difference value;

deriving an final audio signal for play in the front channel only stereo system by converting the estimated transformed surround channel signal into a time domain; and playing the final audio signal in the front channel only stereo system.

2. The method of generating surround channel audio according to claim 1, wherein transforming the front audio channel signal and the surround channel signal into frequency-domain signals comprises transforming the front audio channel signal and the surround channel signal by short-time Fourier transform (STFT).

3. The method of generating surround channel audio according to claim 1, further comprising:

normalizing the difference value and the transformed front audio channel signal to a value of 0 to 1.

4. The method of generating surround channel audio according to claim 1, wherein the difference value is obtained by subtracting a certain proportion of the transformed front audio channel signal from the transformed surround channel signal.

5. The method of generating surround channel audio according to claim 4, wherein the certain proportion is represented by $\epsilon$ for limiting the range of the estimated transformed surround channel signal generated from the DNN model, and has a value of 0.5 such that the estimated transformed surround channel signal comprises a certain portion of the transformed front audio channel signal.

6. The method of generating surround channel audio according to claim 1, wherein deriving the estimated transformed surround channel signal comprises calculating a sum of a certain proportion of the transformed surround channel signal and the estimated difference value.

7. The method of generating surround channel audio according to claim 6, wherein the certain proportion is represented by $\epsilon$ and set to a value of 0.5, $\epsilon$ being a factor serving to adjust a degree of limiting the transformed front audio channel signal.

8. The method of generating surround channel audio according to claim 1, wherein deriving the final audio signal comprises converting the estimated transformed surround channel signal into a time domain by inverse STFT with reference to a phase of the front audio channel signal.

* * * * *